United States Patent [19]

Bruni et al.

[11] 4,045,189

[45] Aug. 30, 1977

[54] METHOD FOR PREPARING FUEL MIXTURES FOR TORCHES AND BURNERS

[75] Inventors: Maurice Bruni, Tremblay lesGonesses; Georges Sëris, Anthony, both of France

[73] Assignee: L'Air Liquide, Societe Anonyme pour l'Etude et l'Exploitation des procedes Georges Claude, Paris, France

[21] Appl. No.: 697,259

[22] Filed: June 17, 1976

[30] Foreign Application Priority Data

June 20, 1975 France ..... 75.19303

[51] Int. Cl.[2] ..... F17D 1/04; C10L 3/02

[52] U.S. Cl. ..... 48/190; 48/197 FM; 44/52; 62/48; 62/52

[58] Field of Search ..... 48/190, 180 R, 180 H, 48/180 P, 196 FM, 197 FM, 199 FM; 62/9, 48, 52; 252/372; 44/52; 206/.6, .7

[56] References Cited

U.S. PATENT DOCUMENTS

| | | | |
|---|---|---|---|
| 727,609 | 5/1903 | Fouche | 62/48 |
| 1,230,531 | 6/1917 | Stephenson | 62/48 |
| 1,339,431 | 5/1920 | Backhaus | 206/.6 |
| 1,889,162 | 11/1932 | Thomas et al. | 62/48 |
| 3,071,452 | 1/1963 | Braconier et al. | 48/190 |
| 3,706,542 | 12/1972 | Gilks | 48/197 FM |
| 3,861,160 | 1/1975 | Walker | 62/48 |
| 3,883,322 | 5/1975 | Bivins | 48/180 R |

FOREIGN PATENT DOCUMENTS

| | | | |
|---|---|---|---|
| 630,221 | 10/1949 | United Kingdom | 48/197 FM |

*Primary Examiner*—S. Leon Bashore
*Assistant Examiner*—Peter F. Kratz
*Attorney, Agent, or Firm*—Browdy and Neimark

[57] ABSTRACT

A fuel mixture, comprising from 10 to 60 mols % acetylene and from 40 to 90 mols % ethylene, is prepared by mixing the two constituents in the gaseous phase at a pressure slightly above atmospheric pressure and at a temperature ranging from −25° C. to +20° C.

5 Claims, 1 Drawing Figure

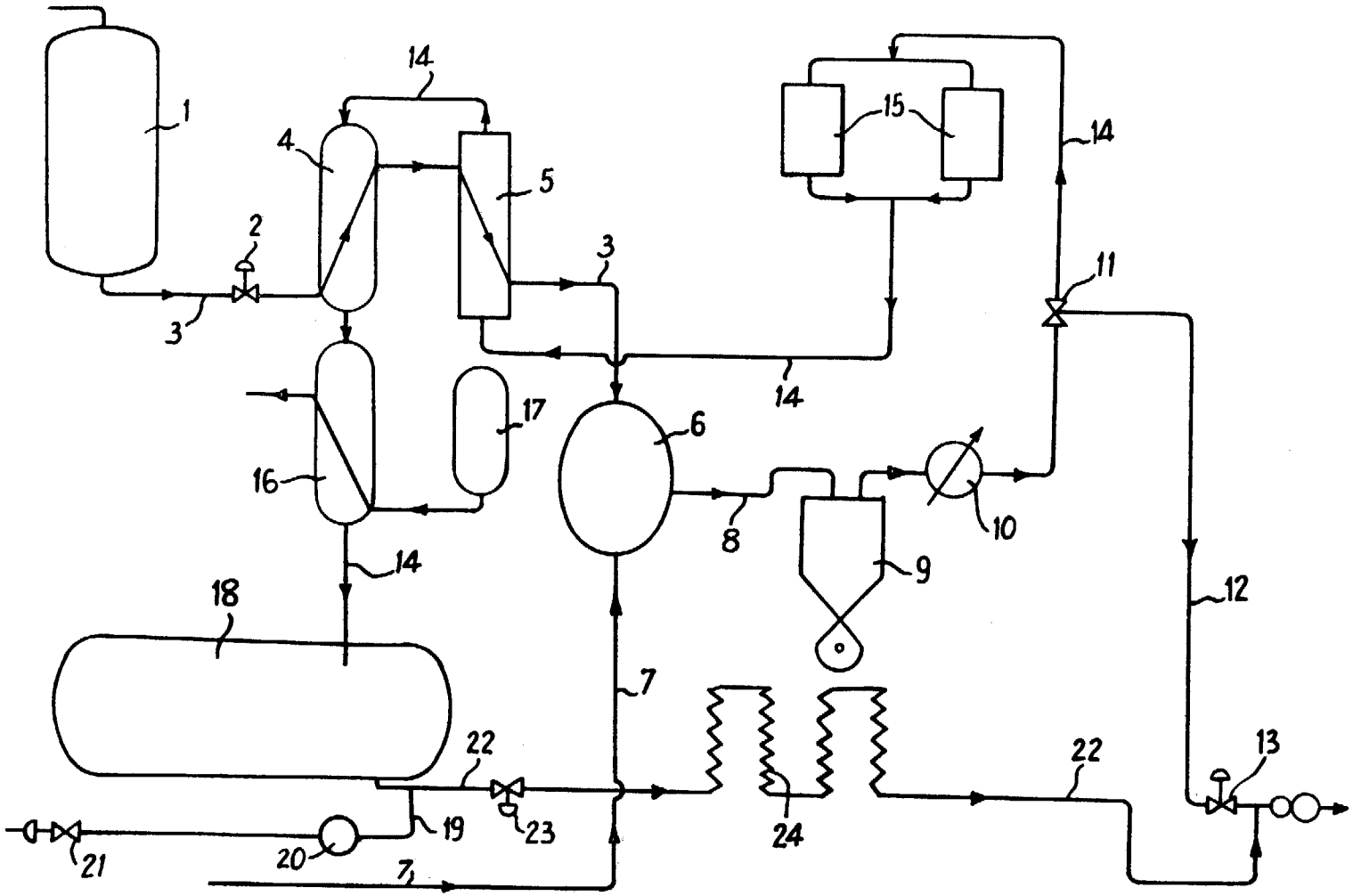
1
2
3
4
5
6
7
8
9
10
11
12
13
14
15
16
17
18
19
20
21
22
23
24

METHOD FOR PREPARING FUEL MIXTURES FOR TORCHES AND BURNERS

BACKGROUND OF THE INVENTION

This invention relates to a method of obtaining a fuel mixture for torches and burners used for welding and cutting.

For more than 50 years, it has been conventional to use acetylene as the fuel for torches and burners for welding and cutting apparatus. The nature of acetylene, however, is such that it is dangerous to store it when compressed and on its own, and it is conventionally stored, after being compressed and dissolved in a solvent such as acetone, in a porous material. Under these conditions the amount of acetylene which can be stored or transported is low relative to the weight of the container and of its contents. Methods have been proposed for the transport and storage of acetylene in liquid form, but pure liquid acetylene is not used, owing to the risk of explosion and the difficulty of handling it.

It has recently been proposed to use acetylene mixtures, which avoid the risk of explosion and can give a sufficiently high combustion temperature for welding and oxygen cutting. These liquid fuel mixtures, which contain from 60 to 10 mols% acetylene and from 40 to 90 mols % ethylene, can be stored or transported at normal temperature in compressed form at a pressure of about 80 kg/cm$^2$. When the liquid mixture is stored at this relatively high pressure, it has to be supplied in cylinders, usually of low capacity, which means that the cost of using it is relatively high and it cannot be distributed on a large scale by a pipe system.

It is an object of the present invention to provide a method of preparing a fuel mixture comprising from about 10 to about 60 mols % of acetylene and from about 40 to about 90 mols % of ethylene in a form suitable for distribution by pipeline or in bulk by a conventional isothermal tanker lorry, and for storing in a user's tank.

SUMMARY OF THE INVENTION

According to one aspect of the present invention there is provided a method of preparing a fuel mixture, suitable for torches and burners to be used in welding and cutting operations and comprising from about 10 to about 60 mols % acetylene and from about 40 to about 90 mols % ethylene, which method comprises mixing acetylene and ethylene in the gaseous phase in desired proportions at a pressure slightly above atmospheric pressure and at a temperature in the range of from −25° C. to +20° C.

According to another aspect of the invention there is provided an installation, for use in preparing a fuel mixture which apparatus comprises a storage vessel for liquid ethylene; a boiler in which ethylene from said storage vessel can be evaporated in counter-current with a fraction of the fuel mixture; a heat exchanger in which the evaporated ethylene can be heated in counter-current with the fraction of the gaseous fuel mixture; a mixing unit comprising means for admixing acetylene in controlled proportions with said evaporated and heated ethylene to form a fuel mixture; a compressor in which said fuel mixture can be compressed; a cooler for cooling the compressed fuel mixture; means for bleeding off a fraction of the cooled and compressed fuel mixture in gaseous forms; a drier in which the remainder of the cooled and compressed fuel mixture can be dried; means for conveying the cooled, compressed and dried fuel mixture to said heat exchanger and said boiler; a liquid nitrogen-cooled condenser in which said remainder of the fuel mixture can be cooled to a desired low temperature; a vessel for storing the cooled liquid fuel mixture; means for withdrawing the cooled liquid fuel mixture; and a pipeline for withdrawing some liquid mixture from said vessel and conveying it to a distribution system for the gaseous fuel mixture, there being a valve, a heat exchanger and a vaporiser disposed in said pipeline.

The fuel mixture is produced at a pressure ranging from about 1.05 to about 1 bar absolute (abbreviated herein to "bara") measured at the compression intake immediately after the mixing operation.

The fuel mixture can be obtained from ethylene in an initially cold liquid form and from acetylene at ambient temperature, substantially all the negative kilo-calories of the ethylene being used to cool the acetylene and prepare a gaseous mixture at a slight pressure, the pressures not being necessarily equal.

According to a preferred embodiment of the invention, the gaseous mixture is compressed to a pressure in the range of from 2 to 5 bara after its production.

Owing to the flexibility of the method of the invention, the fuel mixture can be distributed in gaseous form at a pressure ranging from 2 to 5 bara, and can be stored and transported in liquid, cold form within the same pressure range. The mixture can be stored or transported in liquid form at a temperature between −50° and −90° C., depending on the chosen storage pressure.

In one embodiment, the ethylene is initially in liquid form at a temperature between −80° and −100° C. at a pressure slightly above atmospheric pressure, of the order of 1.4 to 3.4 bara.

The ethylene is first vaporised than heated to a temperature between −30° and −25° C. then mixed with gaseous acetylene introduced at ambient temperature in the chosen proportions. A mixture in the gaseous phase is obtained at a temperature between −25° and −20° C. at a pressure very slightly above atmospheric pressure. The mixture is then compressed at a pressure ranging from 2 to 5 bara. A fraction of the resulting fuel mixture is distributed in gaseous form at a pressure ranging from 2 to 5 bara. The other fraction of the fuel mixture is dried, if required, then cooled, condensed by cold exchange with the cold ethylene, and stored in liquid from at a pressure ranging from 2 to 5 bara.

In one embodiment, the acetylene is dried before being admixed with the ethyelene.

For a better understanding of the invention and to show how the same may be carried into effect, reference will now be made, by way of example, to the accompanying drawing which shows an installation for preparing a fuel mixture by the method of the invention.

The installation comprises a tank 1 for storing ethylene, a valve 2 on a pipe 3 for introducing ethylene into a boiler 4 in which the ethylene is vaporised by counter-current cold exchange with a fraction of the fuel mixture (which has already been prepared), after which the gaseous ethylene is heated in a heat exchanger 5 in counter-current and with cold exchange with said fraction of the gaseous fuel mixture. After being vaporised and heated to a temperature in the range of from −25° C. to +20° C. in said boiler and heat exchanger, ethylene is introduced via pipe 3 into a mixing unit 6 which comprises means for introducing acetylene in controlled proportions, the acetylene arriving at the mixing unit via a pipe 7. The gaseous fuel mixture thus produced is withdrawn from the mixing unit via a pipe 8 and conveyed to a compressor 9 in which it is compressed before being cooled in a cooler 10. A multi-way valve 11 is used to bleed off a fraction of the fuel mixture in gaseous form and under a slight pressure, so that it can be distributed by a pipe 12 and via an expansion valve 13. The other fraction of the fuel mixture is bled off via a pipe 14 and is conveyed to a drier 15. This other fraction enters the heat exchanger 5 at ambient temperature and is cooled therein and also in boiler 4 by cold exchange with the cold ethylene, and is then cooled in a liquid nitrogencooled condenser 16 (for starting or for safety purposes), the nitrogen coming from tank 17. The liquid, cold fuel mixture is stored under a slight pressure in a storage tank, provided with withdrawal means. The liquid fuel mixture can be conveyed by a pipe 19, via a pump 20 and a valve 21, to a tanker. If there is a considerable demand for a gaseous fuel mixture, a fraction thereof can be withdrawn via a pipe 22, under the control of a valve 23. After travelling through exchanger 24, the fraction of the gaseous fuel mixture is combined with the first fraction of the same mixture flowing in pipe 12.

The invention is further illustrated by the following specific Example.

The liquid ethylene used for the process is at a temperature of −100° C. and a pressure of 1.4 bara. On leaving the boiler 4 after being vaporised, it is at a temperature of −90° C. and at a pressure of 1.4 bara. After travelling through the heat exchanger 5 it is at a temperature of −26° C and a pressure of 1.15 bara and, in gaseous form, enters the mixing unit 6 at a flow rate of 100 $m^3/h$ at −15° C. Acetylene at 20° C. and atmospheric pressure is admixed with the ethylene at the rate of 20 $m^3/h$ at −15° C. The fuel mixture produced in the mixing unit is withdrawn at a temperature of 15° C. and at a pressure of 1.05 bara. It is then compressed in the compressor 9 to 5 bara, then cooled in the cooler 10 to ambient temperature, i.e. approx. 20° C. The fraction of the mixture for distribution in gaseous form is withdrawn at a pressure of 2.5 bara. The second fraction of the gaseous mixture is dried in the dryer 15 to less than 100 ppm moisture. The dry fuel mixture, which is at a pressure of 4.8 bara and a temperature of 20° C., is cooled to −60° C. in the heat exchanger by cold exchange with ethylene. At the outlet of boiler 4, the temperature drops to −75° C. and the pressure is 4.2 bara. After the liquid fuel mixture has travelled through the liquid-nitrogen condenser 16, its temperature is −80° C. and it is at a pressure of 3.9 bara. The liquid mixture is stored under these temperature and pressure conditions, and most of it is withdrawn for filling thermally super-insulated tankers. However, part of the liquid is withdrawn and sent through an expansion valve whereat it suffers a pressure drop from 3.9 to 2.5 bara; thereafter it is heated to approx. 20° C. in the exchanger 24 and combined with the mixture distributed in gaseous form.

We claim:

1. A method of preparing a fuel mixture suitable for torches and burners to be used in welding and cutting operations and comprising from about 10 to about 60 mol % acetylene and from about 40 to about 90 mol % ethylene, comprising the steps of 1. providing liquid ethylene at a temperature of −100° to −80° C and at a pressure on the order of about 1.4 to 3.4 bara;
2. providing acetylene at ambient temperature;
3. first vaporizing and then heating said ethylene to a temperature of − 30° to −25° C;
4. mixing said acetylene and said gaseous ethylene in desired proportions at a pressure very slightly above atmospheric and at a temperature in the range of −25° to +20° C;
5. compressing said mixture to a pressure of 2 to 5 bara;
6. distributing a first fraction of said compressed mixture at a pressure of 2 to 5 bara, and cooling and condensing said second fraction by passing the remaining second fraction in heat exchange relationship with said ethylene to effect said vaporizing and heating of said ethylene in step (3), and storing the resultant liquid mixture at 2 to 5 bara.

2. A method in accordance with claim 1 wherein said fuel mixture comprises about 20% acetylene and about 80% ethylene.

3. A method in accordance with claim 1 wherein in step (6) said second fraction is dryed prior to said cooling and condensing.

4. A method according to claim 1, wherein the mixture is stored or transported in liquid form at a temperature ranging from −90° to −50° C., depending on the chosen storage pressure.

5. A method of preparing a fuel mixture according to claim 1, wherein the acetylene is dried before mixing.

* * * * *